US009142893B2

(12) United States Patent
Son et al.

(10) Patent No.: US 9,142,893 B2
(45) Date of Patent: Sep. 22, 2015

(54) POLARIZER ROTATING DEVICE FOR MULTI POLARIZED SATELLITE SIGNAL AND SATELLITE SIGNAL RECEIVING APPARATUS HAVING THE SAME

(75) Inventors: Min-Son Son, Hwaseong-si (KR); Ho-Seon Lee, Cheonan-si (KR)

(73) Assignee: INTELLIAN TECHNOLOGIES INC. (KR)

( * ) Notice: Subject to any disclaimer, the term of this patent is extended or adjusted under 35 U.S.C. 154(b) by 47 days.

(21) Appl. No.: 13/981,409

(22) PCT Filed: Nov. 28, 2011

(86) PCT No.: PCT/KR2011/009117

§ 371 (c)(1),
(2), (4) Date: Jul. 24, 2013

(87) PCT Pub. No.: WO2012/102475

PCT Pub. Date: Aug. 2, 2012

(65) Prior Publication Data

US 2013/0307721 A1 Nov. 21, 2013

(30) Foreign Application Priority Data

Jan. 27, 2011 (KR) ..... 10-2011-0008046

(51) Int. Cl.
*H01Q 15/24* (2006.01)
*H01Q 3/02* (2006.01)
(Continued)

(52) U.S. Cl.
CPC ..... *H01Q 15/246* (2013.01); *H01P 1/062* (2013.01); *H01Q 1/34* (2013.01); *H01Q 1/42* (2013.01);
(Continued)

(58) Field of Classification Search
CPC .. H01Q 15/246; H01Q 15/244; H01Q 15/242
USPC ..... 333/21 A
See application file for complete search history.

(56) References Cited

U.S. PATENT DOCUMENTS 3,541,563 A 11/1970 Staehlin
3,569,870 A * 3/1971 Foldes ..... 333/21 R
(Continued)

FOREIGN PATENT DOCUMENTS

KR 100131979 12/1997
KR 1020100131147 12/2010

OTHER PUBLICATIONS

European Search Report—European Application No. 11857062.1, issued on Jun. 25, 2014, citing US 2010/238082, US 4 613 836 and US 3 541 563.
(Continued)

*Primary Examiner* — Stephen E Jones
*Assistant Examiner* — Scott S Outten
(74) *Attorney, Agent, or Firm* — Cantor Colburn LLP

(57) ABSTRACT

There are provided a polarizer rotating device and a satellite signal receiving apparatus having the same. The satellite signal receiving apparatus includes a feedhorn that receives a satellite signal; a low noise block down converter that processes the signal received by the feedhorn; a skew compensating device that is provided at the low noise block down converter or the feedhorn and rotates the low noise block down converter or the feedhorn to compensate for a skew angle when the satellite signal received by the feedhorn is a linearly polarized wave; a polarizer that receives a linearly polarized signal and a circularly polarized signal of the satellite signal; and a polarizer rotating device that rotates the polarizer when the satellite signal received by the polarizer is a circularly polarized wave. In such a simple structure, the linearly polarized wave and the circularly polarized wave are all received to be processed.

10 Claims, 17 Drawing Sheets

(51) Int. Cl.

| | |
|---|---|
| ***H01P 1/06*** | (2006.01) |
| ***H01Q 3/08*** | (2006.01) |
| ***H01Q 1/34*** | (2006.01) |
| ***H01Q 1/42*** | (2006.01) |
| ***H01Q 19/19*** | (2006.01) |
| ***H01Q 21/24*** | (2006.01) |
| ***H01Q 13/02*** | (2006.01) |

(52) U.S. Cl.
CPC . *H01Q 3/02* (2013.01); *H01Q 3/08* (2013.01); *H01Q 13/0241* (2013.01); *H01Q 15/244* (2013.01); *H01Q 19/19* (2013.01); *H01Q 21/24* (2013.01)

(56) References Cited

U.S. PATENT DOCUMENTS

| | | | | |
|---|---|---|---|---|
| 4,178,574 | A * | 12/1979 | Edens et al. | 343/756 |
| 4,613,836 | A | 9/1986 | Evans | |
| 6,873,220 | B2 * | 3/2005 | Jan et al. | 333/21 A |
| 2010/0238082 | A1 | 9/2010 | Kits Van Heyningen et al. | |

OTHER PUBLICATIONS

International Search Report—PCT/KR2011/009117 dated Jul. 25, 2012.

* cited by examiner

VERTICALLY/HORIZONTALLY
DOUBLE POLARIZED WAVE

POLARIZER ROTATING DEVICE FOR MULTI POLARIZED SATELLITE SIGNAL AND SATELLITE SIGNAL RECEIVING APPARATUS HAVING THE SAME

CROSS-REFERENCE TO RELATED APPLICATIONS

This application claims the priority of Korean Patent Application No. 10-2011-0008046 filed on Jan. 27, 2011, in the Korean Intellectual Property Office, the disclosure of which is incorporated herein by reference.

BACKGROUND OF THE INVENTION

1. Field of the Invention

The present invention relates to a polarizer rotating device for a multi polarized satellite signal and a satellite signal receiving apparatus having the same. More particularly, the present invention relates to a polarizer rotating device for a multi polarized satellite signal and a satellite signal receiving apparatus having the same with which it is possible to process a linearly polarized wave and a circularly polarized wave of a satellite signal.

2. Description of the Related Art

A reflector antenna has been widely used in satellite communication, a high-capacity radio communication, or the like. The reflector antenna is configured to focus a received signal into at least one focal point by using a principle of a reflecting telescope. In general, a horn antenna or a feedhorn may be provided at the focal point of the reflector antenna. Here, a parabolic antenna may be typically used as the reflector antenna.

The received signal is reflected from the reflector antenna to be transmitted to the feedhorn, and the feedhorn transmits the signal, which has been input to the feedhorn, to a low noise block down converter (LNB) through a waveguide. Then, the low noise block down converter converts the signal, which has received from the feedhorn, into a signal of an intermediate frequency band to transmit the converted signal to an external video playing media such as a TV set-top box. Here, the low noise block down converter is a device that corresponds to a first stage of receiving a signal and is referred to as a kind of electronic amplifier. Some noise is additionally introduced in the low noise block down converter, and the noise introduced in the low noise block down converter is amplified to be transmitted to the next stage. Such noise needs to be minimized in order to maintain an optimal system, and the low-noise block down converter is designed to have a minimum noise level in order to stabilize the entire satellite signal receiving system.

Meanwhile, a conventional low noise block down converter capable of processing a satellite signal of a specific band receives any one signal of a linearly polarized signal and a circularly polarized signal depending on polarization properties of signals received from a satellite.

In a satellite antenna provided on land, since the polarization property is determined depending on regions, a low-noise block down converter for a circularly polarized wave or a low-noise block down converter for a linearly polarized wave is used depending on the determined polarization property. Accordingly, the low-noise block down converter need not be replaced. Unfortunately, the polarization property of the satellite is changed along with the movement of a ship between nations or between continents such that the circularly polarized wave is changed to the linearly polarized wave or the linearly polarized wave is changed to the circularly polarized wave. Thus, a marine satellite antenna needs to selectively receive the linearly polarized wave or the circularly polarized wave. Disadvantageously, in order to selectively receive the linearly polarized wave or the circularly polarized wave, since it is necessary to replace the low-noise block down converter, there is a troublesome work.

In particular, since a marine satellite tracking antenna has a complicated device including a radome and is provided under antenna circumstances of shaking due to waves, if there is a lack of specialized knowledge about the assembly and disassembly of the marine antenna, it is difficult to manually replace a low noise block down converter for a circularly polarized wave and a low noise block down converter for a linearly polarized wave. In order to solve such a problem, there has been suggested an apparatus capable of receiving both the linearly polarized wave and the circularly polarized wave. However, such an apparatus has a large size unsuitable for a marine antenna or an antenna for a ship. Further, it is required that waveguides for individually receiving the linearly polarized wave and the circularly polarized wave are provided at the apparatus and a feedhorn antenna is moved to correspond to the individual waveguides. Thus, there is a demerit that the structure thereof is complicated.

In addition, when a conventional feeding system for a linearly polarized wave and a conventional feeding system for a circularly polarized wave are simply connected, it is difficult to commercialize the systems due to large loss caused by interference between the linearly polarized wave and the circularly polarized wave. When the feeding systems are separately attached, there is a problem that a manufacturing cost is excessively increased.

Furthermore, when a linearly polarized satellite signal is received, it is necessary to implement a function for automatically compensating for a skew angle in order to compensate for loss caused by a polarization angle caused between the linearly polarized satellite signal and a polarized wave received by the antenna. In other words, when the linearly polarized satellite signal is received, it is difficult to implement a function of controlling the skew angle by compensating for an error between a direction of the linearly polarized satellite signal and a polarization direction of the low noise block down converter for a linearly polarized wave and automatically aligning the low noise block down converter. Due to Faraday rotation caused when the linearly polarized signal transmitted from the satellite passes through the ionosphere, the skew angle is caused between the antenna at the transmission side and the low noise block down converter at the reception side. Since the skew angle causes polarization loss to attenuate the magnitude of the signal, it is necessary to compensate for the skew angle. The reason why the skew angle is caused is briefly explained below. Since all satellites exist above the equator of the earth and the earth is round, as the linearly polarized wave propagates toward the polar regions of the Earth, the linearly polarized wave is curved to cause the skew angle.

In order to receive a signal from the satellite that uses the linearly polarized wave depending on a position of the moving body such as a ship, it is required that the antenna is rotated by the skew angle to compensate for the skew angle. However, in such a method, since the antenna is rotated, there is a problem that the size of the antenna is increased, the manufacturing cost thereof is increased, and large power loss is caused.

For example, in Europe or Asia that uses the linearly polarized signal, in order to receive the linearly polarized satellite signal, there is an inconvenience that the antenna is rotated to compensate for the skew angle. Meanwhile, when the skew angle is not compensated, there is a problem that loss of the satellite signal is caused. In addition, since a moving body such as a ship, an airplane or a vehicle does not have a space enough to provide receiving apparatuses for respectively processing the linearly polarized wave and the circularly polarized wave, there is a great demand for a technology capable of receiving all the multi polarized waves by a single signal receiving apparatus and selectively receiving the circularly polarized wave or the linearly polarized wave while occupying a minimum operation space.

SUMMARY OF THE INVENTION

An aspect of the present invention provides a polarizer rotating device for a multi polarized satellite signal and a satellite signal receiving apparatus having the same with which it is possible to process a multi polarized satellite signal having a linear polarization property and a circular polarization property by using a single low noise block down converter.

An aspect of the present invention also provides a polarizer rotating device for a multi polarized satellite signal and a satellite signal receiving apparatus having the same with which it is possible to easily implement, as a simple structure, a function of processing a multi polarized satellite signal having a linear polarization property and a circular polarization property by using a single low noise block down converter.

An aspect of the present invention also provides a polarizer rotating device for a multi polarized satellite signal and a satellite signal receiving apparatus having the same with which it is possible to automatically compensate for an skew angle caused between a polarized satellite signal and a polarized wave received by a feedhorn when a signal transmitted from a satellite is a linearly polarized wave.

An aspect of the present invention also provides a polarizer rotating device for a multi polarized satellite signal and a satellite signal receiving apparatus having the same with which it is possible to receive both a linearly polarized wave and a circularly polarized wave by using a single open waveguide.

According to an aspect of the present invention, there is provided a satellite signal receiving apparatus including a feedhorn that receives a satellite signal; a low noise block down converter that processes the signal received by the feedhorn; a skew compensating device that is provided at the low noise block down converter or the feedhorn and rotates the low noise block down converter or the feedhorn to compensate for a skew angle when the satellite signal received by the feedhorn is a linearly polarized wave; a polarizer that receives a linearly polarized signal and a circularly polarized signal of the satellite signal; and a polarizer rotating device that rotates the polarizer when the satellite signal received by the polarizer is a circularly polarized wave.

The low noise block down converter may include a processing module that includes a processing part for processing a band of the signal received by the feedhorn; and a signal transmission part that is formed at the processing module and includes a single waveguide formed communicatively at a position facing the processing part such that the signal received by the feedhorn is transmitted to the processing part.

The polarizer rotating device may include a polarizer rotating section that rotates the polarizer provided rotatably within the single waveguide by a predetermined angle in a circumferential direction of the single waveguide.

A polarized wave forming section may be formed at an inner surface of the polarizer in a height direction of the single waveguide, and the polarizer rotating part may rotate the polarizer so as to allow the polarized wave forming part to be located in the same direction as an input probe of the low noise block down converter or in a direction different from the probe.

The polarizer may include a feedhorn connecting part that is provided within the single waveguide to be rotated relative to the single waveguide and is communicatively connected to the feedhorn; a polarized wave forming part that is formed at an inner surface of the feedhorn connecting part in a height direction of the feedhorn connecting part; and a driven part that is formed at one end of the feedhorn connecting part to receive a driving power of the polarizer rotating section.

The driven part may be formed to extend in a radial direction of the feedhorn connecting part, and includes a rotation restricting part formed to have the same radius of curvature as that of the feedhorn connecting part.

An angle between both ends of the rotation restricting part may be 45 degrees with respect to a center of the feedhorn connecting part.

A stopper that is inserted into the rotation restricting part to restrict a rotation angle of the polarizer may be formed at the low noise block down converter.

When the stopper comes in contact with one end of the rotation restricting part, the polarized wave forming part may be located in the same direction as an input probe of the low noise block down converter, and when the stopper comes in contact with the other end of the rotation restricting part, the polarized wave forming part may be located in a direction different from the input probe.

When an angle between the polarized wave forming part and an input probe of the low noise block down converter is angles obtained by adding 45 degrees to multiples of 90 degrees, the polarizer may receive the circularly polarized wave, and when the angle between the polarized wave forming part and the input probe is angles which are multiples of 90 degrees, the polarizer may receive the linearly polarized wave.

The polarizer rotating section may be connected to the driven part in a direct power transmitting manner, or in an indirect transmitting manner using a gear, a belt, or a chain.

According to another aspect of the present invention, there is provided a polarizer rotating device for multi polarized satellite signal including a polarizer that converts a circularly polarized wave into a linearly polarized wave by being rotated by a predetermined angle when a satellite signal received by a feedhorn is the circularly polarized wave; and a polarizer rotating section that drives the polarizer to be rotated in different manners when the satellite signal received by the feedhorn is the linearly polarized wave and when the satellite signal received by the feedhorn is the circularly polarized wave.

A polarized wave forming part may be formed at an inner surface of the polarizer in a height direction of a single waveguide, and the polarizer rotating section may rotate the polarizer to allow the polarized wave forming part to be located in the same direction as an input probe of a low noise block down converter or in a direction different from the probe.

The polarizer may include a feedhorn connecting part that is provided within a single open waveguide to be rotated relative to the single waveguide connected communicatively to the feedhorn; a polarized wave forming part that is formed at an inner surface of the feedhorn connecting part in a height direction of the feedhorn connecting part; and a driven part that is formed at one end of the feedhorn connecting part to receive a driving power of the polarizer rotating section.

When the satellite signal received by the polarizer is the circularly polarized wave, the polarizer rotating section may rotate the polarizer by angles which are multiples of 45 degrees.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
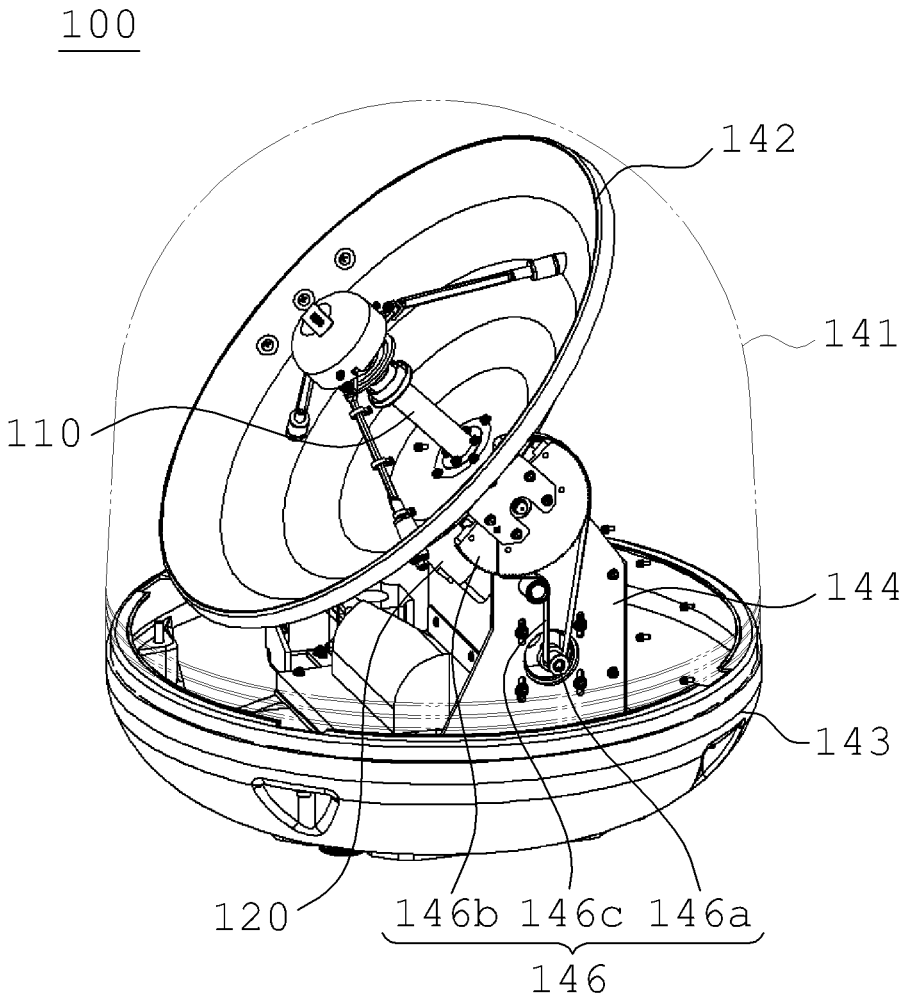
FIG. 1 is a perspective view illustrating a satellite signal receiving apparatus according to an exemplary embodiment of the present invention.

Exemplary embodiments of the present invention will now be described in detail with reference to the accompanying drawings.

As set forth above, according to exemplary embodiments of the present invention, a polarizer rotating device for a multi polarized satellite signal and a satellite signal receiving apparatus having the same can easily receive and automatically process a multi polarized signal having a linear polarization property and a circular polarization property by using a single waveguide.

According to exemplary embodiments of the present invention, a polarizer rotating device for a multi polarized satellite signal and a satellite signal receiving apparatus having the same can be formed as a single apparatus having a simple and compact structure. Thus, it is possible to simply manufacture the satellite signal receiving apparatus and to easily ensure an installation space thereof.

According to exemplary embodiments of the present invention, a polarizer rotating device for a multi polarized satellite signal and a satellite signal receiving apparatus having the same can receive a multi polarized signal having a linear polarization property and a circular polarization property by using a single feedhorn and a single waveguide. As a result, it is possible to reduce the number of feedhorns and the number of waveguides to thereby save cost for components.

According to exemplary embodiments of the present invention, in a polarizer rotating device for a multi polarized satellite signal and a satellite signal receiving apparatus having the same, since an skew angle caused when receiving a linearly polarized wave is automatically compensated, it is prevent loss of a signal. Further, by rotating a low noise block down convert by a skew compensating device, it is possible to reduce power consumption for the skew compensation.

According to exemplary embodiments of the present invention, in a polarizer rotating device for a multi polarized satellite signal and a satellite signal receiving apparatus having the same, since reception of a multi polarized signal and skew compensation can be implemented by a single low noise block down converter, it is possible to improve the convenience of maintenance.

According to exemplary embodiments of the present invention, a polarizer rotating device for a multi polarized satellite signal and a satellite signal receiving apparatus having the same can prevent loss due to interference occurring between a linearly polarized wave and a circularly polarized wave.

While the present invention has been shown and described in connection with the exemplary embodiments, it will be apparent to those skilled in the art that modifications and variations can be made without departing from the spirit and scope of the invention as defined by the appended claims.

Hereinafter, exemplary embodiments of the present invention will be described in detail with reference to the accompanying drawings. However, the present invention is not limited or restricted to the exemplary embodiments. The same reference numerals denoted in the drawings are assigned to the same components.

Figure 2:
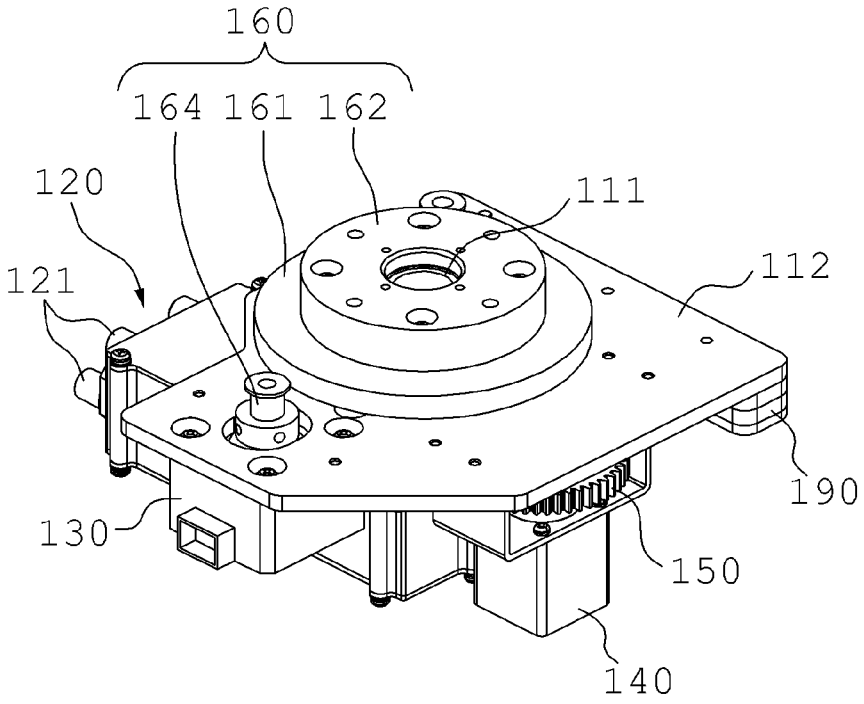
FIG. 2 is an upper perspective view illustrating a major part of the satellite signal receiving device shown in FIG. 1.
Figure 3:
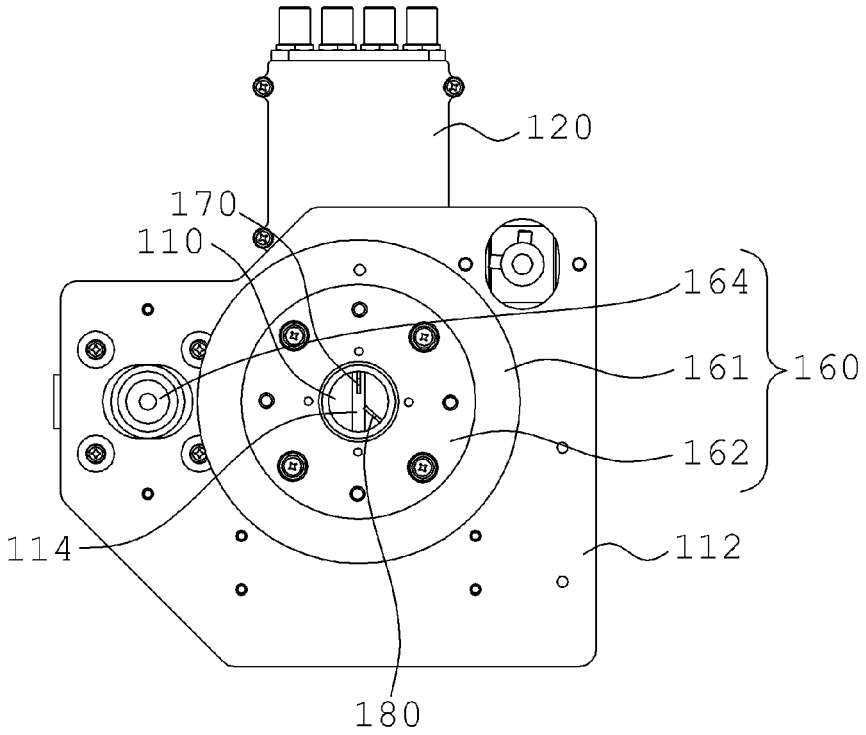
FIG. 3 is a plan view illustrating the major part shown in FIG. 2.
Figure 4:
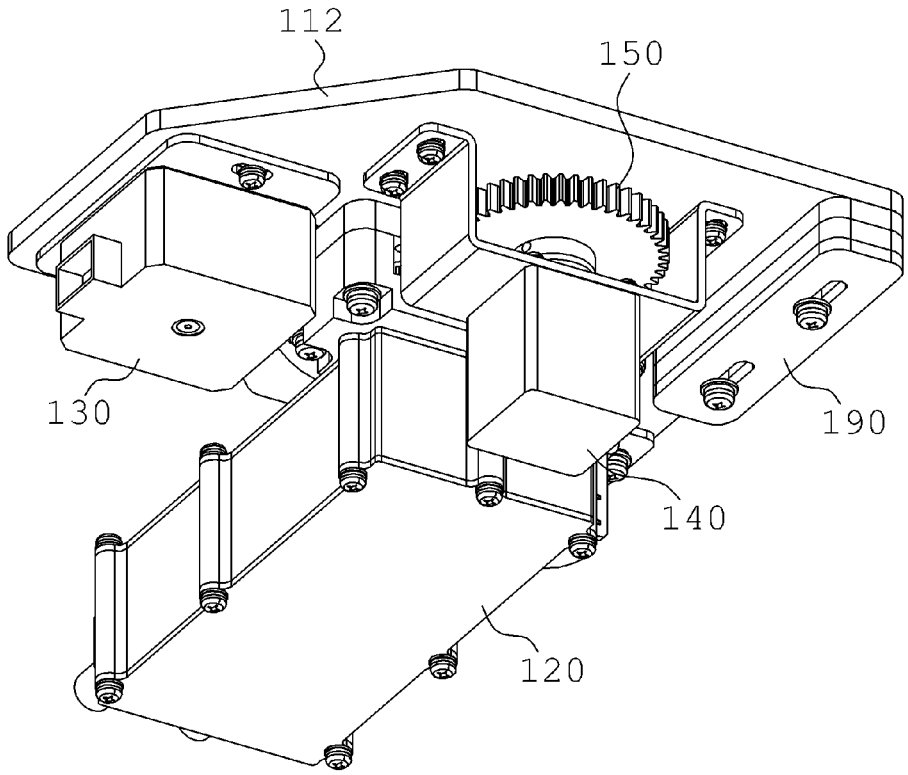
FIG. 4 is a lower perspective view illustrating the major part shown in FIG. 2.
Figure 5:
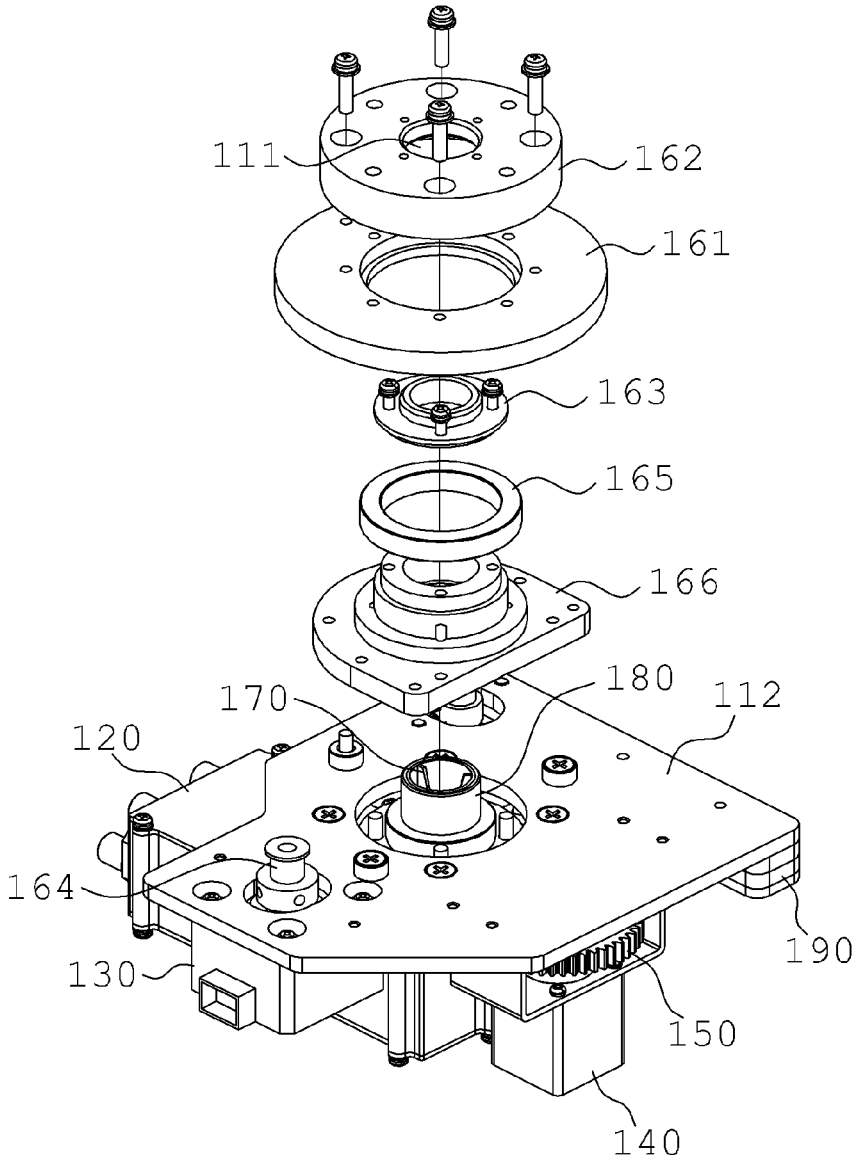
FIG. 5 is an exploded perspective view illustrating the major part shown in FIG. 2.
Figure 6:
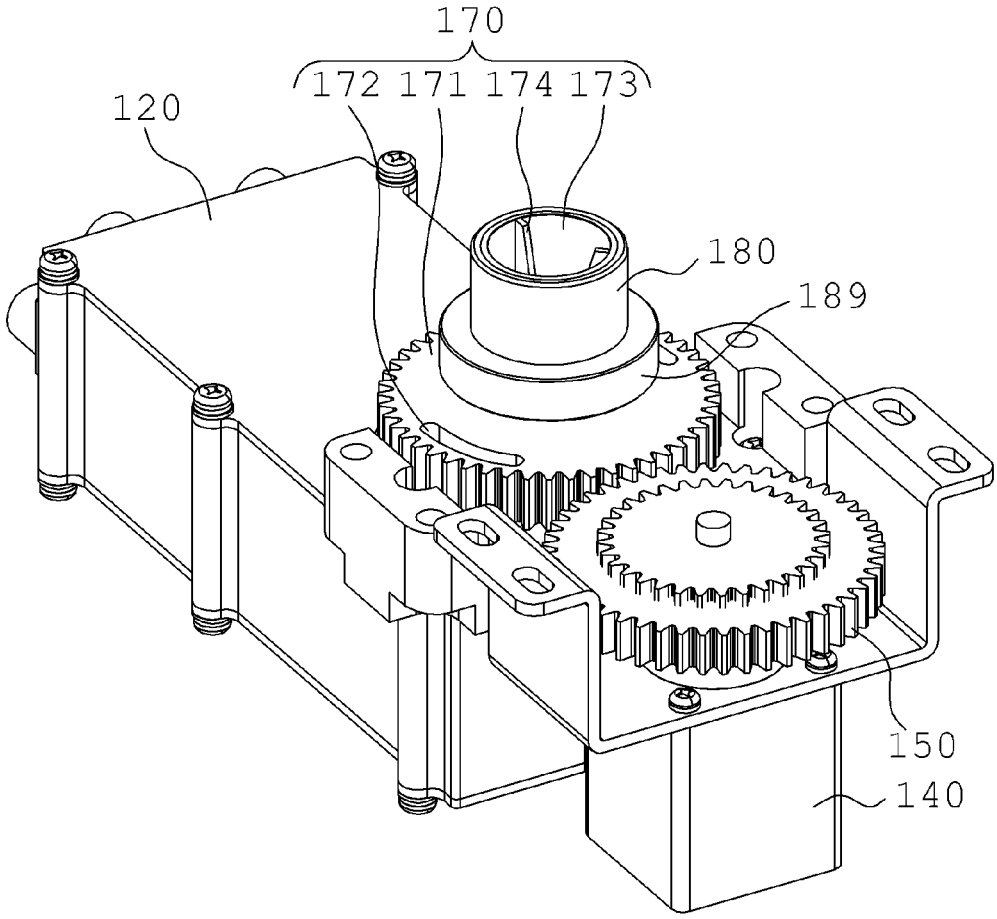
FIG. 6 is a perspective view illustrating a polarizer rotating section of the major part shown in FIG. 2.
Figure 7:
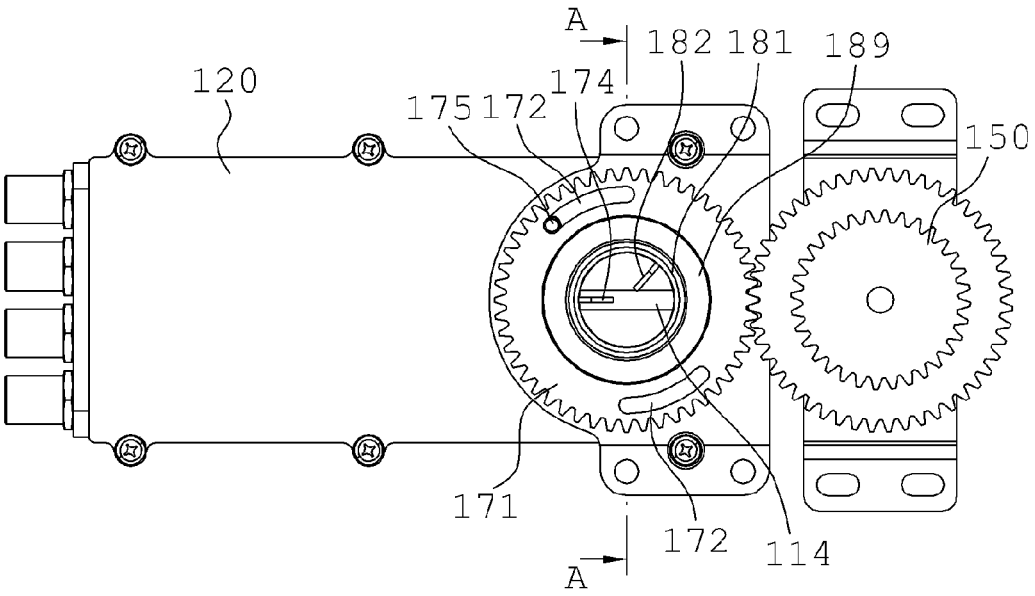
FIG. 7 is a plan view illustrating the polarizer rotating section shown in FIG. 6.
Figure 8:
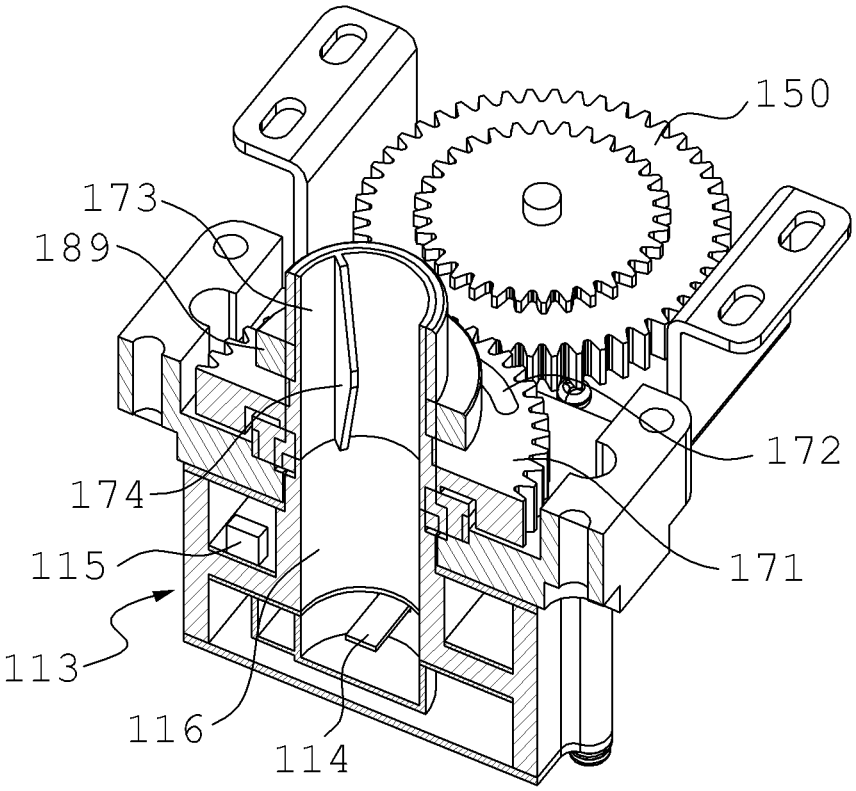
FIG. 8 is a cross-sectional view taken along line A-A shown in FIG. 7.
Figure 9:
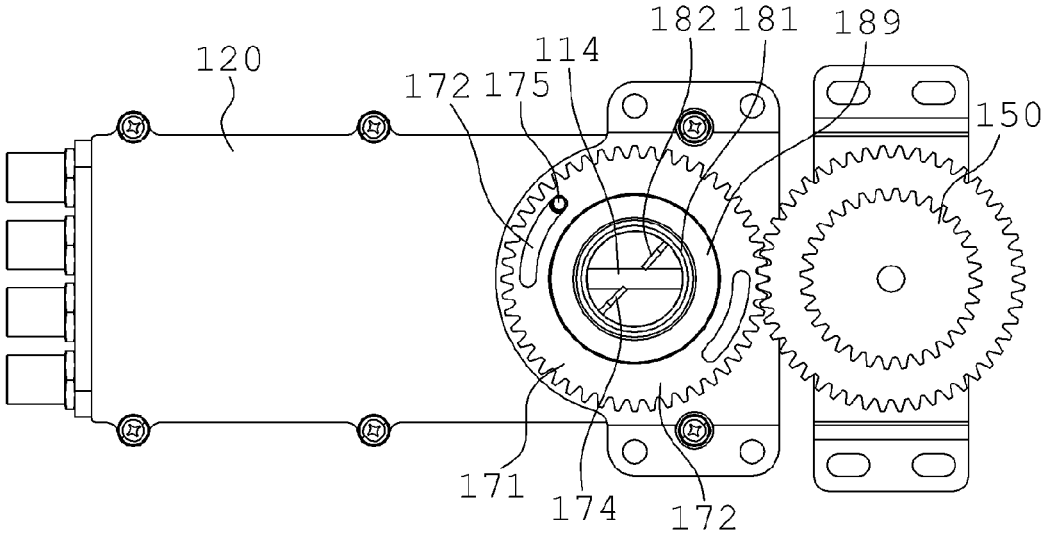
FIG. 9 is a plan view illustrating a state where a polarizer is rotated by the polarizer rotating section illustrated in FIG. 7.
Figure 10A:
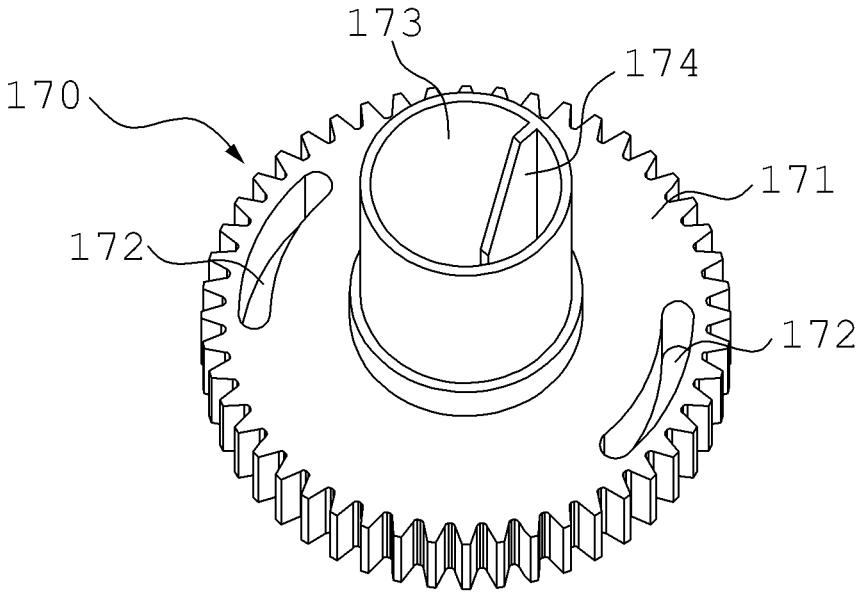
FIGS. 10A and 10B are a perspective view and a plan view illustrating the polarizer shown in FIG. 9, respectively.
Figure 10B:
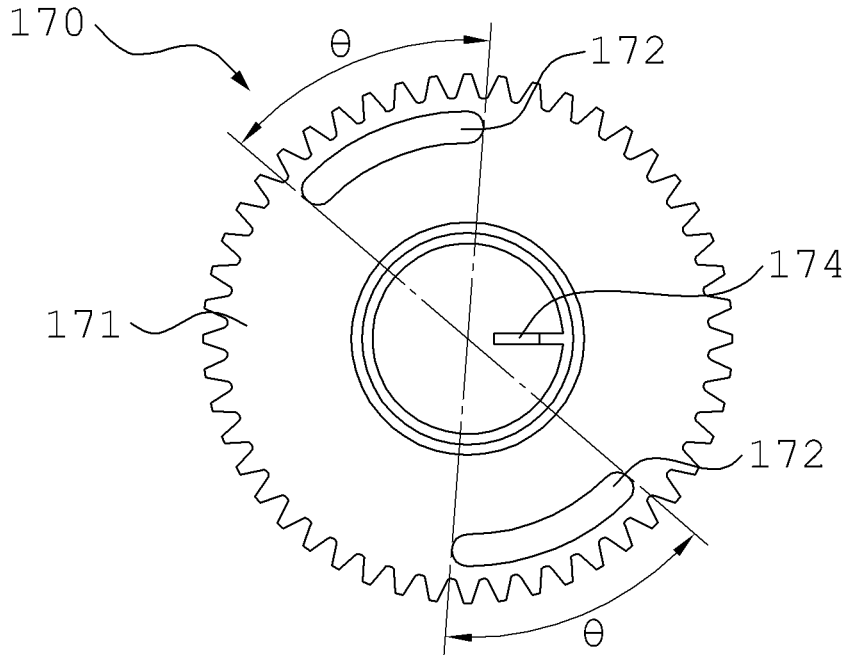

FIG. 1 is a perspective view illustrating a satellite signal receiving apparatus according to an exemplary embodiment of the present invention, FIG. 2 is an upper perspective view illustrating a major part of the satellite signal receiving device shown in FIG. 1, FIG. 3 is a plan view illustrating the major part shown in FIG. 2, FIG. 4 is a lower perspective view illustrating the major part shown in FIG. 2, FIG. 5 is an exploded perspective view illustrating the major part shown in FIG. 2, FIG. 6 is a perspective view illustrating a polarizer rotating section of the major part shown in FIG. 2, FIG. 7 is a plan view illustrating the polarizer rotating section shown in FIG. 6, FIG. 8 is a cross-sectional view taken along line A-A shown in FIG. 7, FIG. 9 is a plan view illustrating a state where a polarizer is rotated by the polarizer rotating section illustrated in FIG. 7, FIGS. 10A and 10B are a perspective view and a plan view illustrating the polarizer shown in FIG. 9, respectively, and FIGS. 11A to 11F are plan views illustrating a case where a waveguide of the major part shown in FIG. 2 receives a linearly polarized wave and a circularly polarized wave.

A satellite signal receiving apparatus 100 is preferably applied to a ship operating on seas, and in the following description, it is described that the satellite signal receiving apparatus 100 is provided at, for example, a marine moving body such as a ship.

Referring to FIGS. 1 to 4, the satellite signal receiving apparatus 100 according to an exemplary embodiment of the present invention includes a feedhorn 110, a low noise block down converter 120, a skew compensating device 160, a polarizer 170, and a single waveguide 180.

The satellite signal receiving apparatus 100 according to the exemplary embodiment of the present invention is an apparatus that is mainly provided at the marine moving body such as a ship operating on seas to receive a signal from a satellite or transmit a signal to the satellite, and may be also referred to as a satellite tracking antenna.

The satellite signal receiving apparatus 100 according to the exemplary embodiment of the present invention may receive signals of a plurality of frequency bands from a plurality of satellites and may also selectively receive multi polarized satellite signals having circularly polarized signals and linearly polarized signals through the single waveguide 180.

Hereinafter, in the exemplary embodiment of the present invention, for convenience of explanation, it is described that signals received by the feedhorn 110 are, for example, linearly polarized signals of Ku band and circularly polarized signals of Ku band. However, the linearly polarized signal of Ku band and the circularly polarized signal of Ku band are merely described as an example, and signals of different frequency bands may be received. Specifically, depending on the number of the low noise block down converters or the size of an opening of the feedhorn, signals of various frequency bands, such as linearly polarized signals of Ka band and circularly polarized signals of Ka band, linearly polarized signals of C band and circularly polarized signals of C band, linearly polarized signals of S band and circularly polarized signals of S band, and linearly polarized signals of L band and circularly polarized signals of L band, may be received. However, in the exemplary embodiment of the present invention, for convenience of explanation, the descriptions thereof will not be presented.

Hereinafter, a method of implementing a marine antenna of receiving only signals of Ku band will be described in detail in connection with an expanded embodiment for processing the multi polarized signals described above. The signal of Ku band is a signal of frequency band ranging from 10.7 GHz to 12.75 GHz.

Referring to FIGS. 1 to 5, the feedhorn 110 is a single waveguide antenna, and functions to receive signals of specific band from the satellite. The feedhorn 110 may have different diameters or shapes from each other depending on frequency bands of the received signals. Specifically, as the frequency band of the received signal is increased, the diameter of the feedhorn 110 may be decreased.

For example, a diameter of the feedhorn for receiving the signals of C band may be larger than that of the feedhorn for receiving the signals of Ku band. Since the feedhorn 110 of the satellite signal receiving apparatus 100 according to the exemplary embodiment of the present invention receives the signals of Ku band, the diameter thereof may be larger than that of the feedhorn for receiving the signal of Ka band.

Further, the feedhorn 110 may be arranged at an upper side of the low noise block down converter 120 with a lower part fixed to a frame 112. The frame 112 is mounted on a reflector antenna 142 to be described below.

Referring to FIGS. 2 to 9, the low noise block down converter 120 is an apparatus that amplifies or converts the signal received by the feedhorn 110 to become a signal of intermediate frequency band. The low noise block down converter 120 may have small noise figure.

The low noise block down converter (LNB) 120 includes a processing module 113 that processes a band of the signal received by the feedhorn 110, a housing (not shown) that is formed to enclose the outside of the processing module 113, and a signal transmission part 116 that is provided with the waveguide 180 through which the signal received by the feedhorn 110 passes.

The processing module 113 includes at least one substrate. The processing module 113 are provided with processing parts 115 that are provided at different positions from each other as electronic circuits to process signals of various frequency bands. The processing parts 115 may be included in the low noise block down converter 120 for processing the signal received by the feedhorn 110.

A polarizer 170 capable of rotating within the single waveguide 180 is provided inside the single waveguide 180. When the signal from the satellite has a polarization property, the polarizer 170 is a device used for processing the polarization property of the signal. The polarizer may be formed in a metal plate shape of arbitrary shape formed in the same direction as a height direction of a cross-section area of the single waveguide 180, and may be also formed in various shapes depending on the polarization property of the signal passing through the single waveguide 180. Specifically, although a cylindrical-shaped polarizer 170 and a plate-shaped polarized wave forming part 174 formed in a pentagonal shape are illustrated in FIG. 8, the shape and the implementing method of the polarizer are not limited thereto. The polarizer may be formed in various shapes and by various implementing methods depending on design conditions.

The polarized wave forming part 174 may be made of a dielectric material, or may be formed in a blade or septum shape. When the polarized wave forming part has the blade or septum shape, the polarized wave forming part may be formed at only one side of an inner surface of a feedhorn connecting part 173 as illustrated in FIG. 8, two facing polarized wave forming parts may be formed at the inner surface of the feedhorn connecting part 173, or a plurality of polarized wave forming parts may be formed at other side surfaces thereof. Furthermore, as another shape different completely from the metal plate shape, the polarized wave forming part may have an iris shape in which a plurality of projections is formed at an inner surface of the single waveguide to serve as the polarizer. That is, the iris-shaped polarized wave forming part may form a polarized wave by using the plurality of projections formed at the inner surface of the feedhorn connecting part in a longitudinal direction thereof. A cross-section shape of the feedhorn connecting part 173 may be a circular shape or a square shape. In this way, the polarized wave forming part 174 may be formed in various shapes depending on requirements.

The single waveguide 180 needs to receive the circularly polarized signal. Thus, when the signal received by the single waveguide 180 is the circularly polarized signal, it is necessary to convert the circularly polarized signal into the linearly polarized signal through the polarizer 170. Further, when the signal received by the single waveguide 180 is the linearly polarized signal, the linearly polarized signal is directly processed without using the polarizer 170. The polarizer 170 according to the exemplary embodiment of the present invention has a structure of rotating depending on whether or not the linearly polarized wave or the circularly polarized wave is received, and the detailed description thereof will be described below.

Furthermore, a plurality of connectors 121 is provided at the low noise block down converter 120. A cable clamp (not shown) for clamping cables connected to the connectors 121 is provided at one side of the low noise block down converter 120.

Meanwhile, a skew compensating device 160 provided at an upper part of the frame 112 is configured to compensate for a skew angle generated when the linearly polarized wave is received by rotating the low noise block down converter 120 with respect to the feedhorn 110 by a certain angle. As shown in FIGS. 2 to 5, the skew compensating device 160 includes a pulley 161 mounted on the frame 112 to be fixed thereto, a reflector flange 162 that comes in contact with an inner circumferential surface of the pulley 161 to be connected to the reflector antenna 142, a bearing 165 that comes in contact with an inner circumferential surface of the reflector flange 162, an adaptor 163 that comes in contact with an inner circumferential surface of the bearing 165 to be connected to the feedhorn 110, and a mount 166 that is mounted on an upper surface of the frame 112 to fasten the pulley 161. A communication hole 111 is formed in a central portion of the reflector flange 162 to transmit the satellite signal received by the feedhorn 110 to the processing module 113.

Moreover, a motor 130 that rotates the pulley 161 relative to the adaptor 163, a driving pulley 164 that is connected directly to a rotational shaft of the motor 130, and a rotational force transmitting member (not shown) configured to transmit rotational force of the motor 130 to the pulley 161 are further provided. Here, examples of the rotational force transmitting member include a timing belt and a chain for connecting the pulley 161 and the driving pulley 164 of the motor 130. In addition, any power transmitting manner including a power transmitting manner using a gear may be adopted.

Due to the skew compensating device 160, large load may be applied to the reflector flange 162 fastened to the reflector antenna 142, so that the skew compensating device 160 may not be smoothly operated or rotated. In order to prevent the problem, as shown in FIG. 4, a counter weight 190 is provided at a position facing the motor 130 around the skew compensating device 160. At this time, the counter weight 190 can adjust weights of the low noise block down converter 120 and the motor 130 depending on loads thereof.

On the other hand, referring again to FIG. 1, the satellite signal receiving apparatus 100 called the satellite tracking antenna according to the exemplary embodiment of the present invention further includes a radome 141, a lower radome 143, the reflector antenna 142, an antenna support 144, and a position adjusting device 146.

The radome 141 is a member that constitutes an external appearance of the satellite signal receiving apparatus 100, and accommodates therein the reflector antenna 142, the feedhorn 110, the low noise block down converter 120, the antenna support 144, the position adjusting device 146, and the skew compensating device 160. Such a radome 141 may be rotatably provided at a ship where the satellite signal receiving apparatus 100 is provided.

The reflector antenna 142 is an auxiliary antenna configured to reflect a signal received from the outside to the feedhorn 110 to improve receiving sensitivity of the feedhorn 110. In the embodiment of the present invention, a parabolic antenna may be used as an example of the reflector antenna 142.

The antenna support 144 is a member that is provided at the radome 141 to rotatably support the reflector antenna 142 and the feedhorn 110. One end of the antenna support 144 may be rotatably connected to at least any one of the reflector antenna 142 or the feedhorn 110. In the following description, the one end of the antenna support 144 is connected to the reflector antenna 142.

The position adjusting device 146 is a device that is provided at the antenna support 144 and adjusts positions of the reflector antenna 142 and the feedhorn 110 to allow the reflector antenna and the feedhorn to track the satellite. The position adjusting device includes a position adjusting motor 146*a* provided at the antenna support 144, a position adjusting gear 146*b* provided at the rotational shaft of the reflector antenna 142, and a position adjusting belt 146*c* arranged at a gear provided at a rotational shaft of the position adjusting motor 146*a* and the position adjusting gear 146*b*. The position adjusting device 146 according to the exemplary embodiment of the present invention may have a biaxial or triaxial driving structure.

Hereinafter, the rotatable polarizer 170 and a polarizer rotating section (140, 150) for rotating the polarizer 170 will be described in detail with reference to the drawings.

The low noise block down converter 120 according to the exemplary embodiment of the present invention may be a polarizer rotating device capable of selectively receiving the linearly polarized signal or the circularly polarized signal of the satellite signal received by the feedhorn 110. Further, as described above, the low noise block down converter 120 may include the processing module 113 having the processing parts 115 for processing the band of the signal received by the feedhorn 110 and the signal transmission part 116 that is provided at the processing module 113 and is located at the position facing the processing parts 115 to allow the signal received by the feedhorn 110 to be transmitted to the processing parts 115 and to be communicatively connected to the single open waveguide 180.

As described above, the polarizer 170 of the satellite signal receiving apparatus 100 according to the exemplary embodiment of the present invention may be provided within the single waveguide 180 to be rotated relative to the single waveguide 180. To achieve this, a polarizer rotating device for a multi polarized satellite signal is used to rotate the polarizer 170. The polarizer rotating device includes the polarizer rotating section (140, 150) for rotating the polarizer 170 by a certain angle along the single waveguide 180 and the polarizer 170 provided rotatably within the single open waveguide 180.

Referring to FIGS. 6 to 10A and 10B, the polarizer rotating section (140, 150) includes a rotation motor 140 attached to a lower surface of the frame 112 and a driving gear 150 connected to a rotational shaft of the rotation motor 140.

The single waveguide 180 is fastened to a body of the low noise block down converter 120 so as to be communicatively connected to the signal transmission part 116, and the rotatable polarizer 170 is provided within the single waveguide 180.

Here, the polarizer 170 includes the feedhorn connecting part 173 that is provided within the single waveguide 180 to be rotated with respect to the single waveguide 180 and is communicatively connected to the feedhorn 110 and the signal transmission part 116, the polarized wave forming part 174 that is provided at the inner surface of the feedhorn connecting part 173 in a height direction or a vertical direction of the feedhorn connecting part 173, and a driven part 171 that is provided at one end of the feedhorn connecting part 173 to receive a driving power of the polarizer rotating section (140, 150).

As illustrated in FIGS. 10A and 10B, the feedhorn connecting part 173 of the polarizer 170 has a cylindrical shape, and the polarized wave forming part 174 is formed within the feedhorn connecting part in the vertical direction so as to correspond to the entire height or vertical length thereof. The polarized wave forming part 174 may have a pentagonal shape to be approximately symmetric, but is not limited thereto.

A driven gear engaging with the driving gear 150 may be provided at an edge of the driven part 171 formed at one end, for example, a lower end of the polarizer 170. The drawing illustrates a case where the driven part 171 of the polarizer 170 is connected in a power transmitting manner using a gear, but is not limited to the power transmitting manner using the gear. The rotational shaft of the rotation motor 140 of the polarizer rotating section and the polarizer 170 may be coaxially connected to each other in a direct power transmitting manner. Alternatively, a driving pulley may be provided instead of the driving gear 150 of the polarizer rotating section and the driven part 171 may be provided as a pulley type, so that the driving pulley and the pulley type driven part may be connected to each other by a timing belt. Otherwise, a driving sprocket may be provided instead of the driving gear 150 and a sprocket may be provided instead of the driven part 171, so that the driving sprocket and the sprocket may be connected to each other by a chain. That is, the polarizer rotating section may be connected to the driven part 171 in the direct transmitting manner, or in an indirect power transmitting manner using the gear, the belt, or the chain.

Meanwhile, the driven part 171 of the polarizer 170 is formed to extend in a radial direction of the feedhorn connecting part 173, and rotation restricting parts 172 having the same radius of curvature as the that of the feedhorn connecting part 173 to restrict a rotation angle of the polarized wave forming part 174 are formed at the extending portions. A bearing 189 is provided at an outer surface of the single waveguide 180 to allow the polarizer 170 to be rotated relative to the mount 166.

The rotation restricting part 172 is formed to have a certain angle with respect to a center of the feedhorn connecting part 173. Referring to FIG. 10B, an angle θ formed by both ends of the rotation restricting part 172 with respect to the center of the feedhorn connecting part 173 may be 45 degrees. In FIG. 10B, the rotation restricting parts 172 are formed to be symmetric with respect to the center of the feedhorn connecting part 173. Here, at least one rotation restricting part 172 may be formed at the driven part 171, and when the rotation restricting parts 172 are provided in plural number as shown in FIG. 10B, the rotation restricting parts 172 do not need to be formed in symmetric with the center of the feedhorn connecting part 173.

Here, stoppers 175 that are inserted into the rotation restricting parts 172 to restrict the rotation angle of the polarizer 170 are formed at the low noise block down converter 120 or the processing module 113. The stoppers 175 are fixed to the low noise block down converter 120 or the processing module 113, whereas the rotation restricting parts 172 are rotated by the polarizer rotating section (140, 150). At this time, when the stoppers 175 come in contact with the both ends of the rotation restricting parts 172, it is preferable that the operation of the polarizer rotating section (140, 150) be stopped. To achieve this, a controller (not shown) configured to detect the contact of the stoppers 175 between the rotation restricting parts 172, transmit the detection result to the polarizer rotating section (140, 150), and stop the operation of the polarizer rotating section (140, 150) may be provided. If such a controller is not provided, even though the stoppers 175 come in contact with the rotation restricting parts 172, the polarizer rotating section (140, 150) is continuously operated, so that the stoppers 175 or the rotation restricting parts 172 may be damaged.

On the other hand, referring to FIGS. 7 to 9, the polarized wave forming part 174 is located to have a certain relationship with an input probe 114 formed at the low noise block down converter 120. Specifically, when the polarizer 170 is rotated by the polarizer rotating section (140, 150), the polarized wave forming part 174 is located at the same position or in the same direction as the input probe 114 or at a position different from the input probe. That is, the polarizer rotating section (140, 150) can rotate the polarizer 170 so as to allow the polarized wave forming part 174 to be located in the same direction as the input probe 114 of the low noise block down converter 120 or in a direction different from the input probe.

Referring again to FIG. 7, it can be seen that the polarized wave forming part 174 of the polarizer 170 is located at the same position as the input probe 114. In such a state, when the polarizer 170 is rotated by the polarizer rotating section (140, 150), the polarized wave forming part 174 of the polarizer 170 moves at the position different from the input probe 114, as shown in FIG. 9.

As shown in FIG. 7, when the stopper 175 comes in contact with the one end of the rotation restricting part 172, the polarized wave forming part 174 is located at the same position as the input probe 114, and when the stopper 175 comes in contact with the other end of the rotation restricting part 172 as shown in FIG. 9, the polarized wave forming part 174 is located at the position different from the input probe 114.

Here, the polarized wave forming part 174 and the input probe 114 being located at the same position means that the polarized wave forming part 174 is located above the input probe 114 as shown in FIG. 7. Meanwhile, the polarized wave forming part 174 being located the position different from the input probe 114 means that the polarized wave forming part 174 is located at a position crossing the input probe 114 as shown in FIG. 9.

In this light, when the stopper 175 comes in contact with the one end of the rotation restricting part 172, an angle between the polarized wave forming part 174 and the input probe 114 becomes 0 degrees, 90 degrees, 180 degrees, or 270 degrees. In contrast, when the stopper 175 comes in contact with the other end of the rotation restricting part 172, the angle between the polarized wave forming part 174 and the input probe 114 becomes 45 degrees, 135 degrees, 225 degrees, or 315 degrees.

Meanwhile, the linearly polarized wave or the circularly polarized wave is received depending on the positions of the polarized wave forming part 174 and the input probe 114. Specifically, when the angle between the polarized wave forming part 174 and the input probe 114 becomes angles obtained by adding 45 degrees to multiples of 90 degrees, the polarizer 170 receives the circularly polarized wave to convert the circularly polarized wave into the linearly polarized wave. Meanwhile, when the angle between the polarized wave forming part 174 and the input probe 114 becomes angles that are multiples of 90 degrees, the polarizer 170 receives the linearly polarized wave itself.

When receiving the circularly polarized signal, the polarized wave forming part 174 of the polarizer 170 can convert the circularly polarized signal into the linearly polarized signal by causing the signal to have a phase difference. In this way, in order to cause the circularly polarized signal to have a phase difference, the polarized wave forming part 174 needs to be located at a position so as to allow an angel between the polarized wave forming part and a power supply direction of the input probe 114 to become 45 degrees or angles that are multiples of 45 degrees.

Further, when receiving the linearly polarized signal, since it is not necessary to cause the signal have a phase difference, the angle between the polarized wave part 174 and the power supply direction of the input probe 114 does not need to become 45 degrees. The linearly polarized wave is classified into a vertically polarized wave and a horizontally polarized wave, and a linearly polarized wave receiving probe 182 is formed within the single waveguide 180 in order to receive the vertically polarized wave and the horizontally polarized wave.

Meanwhile, the polarized wave forming part 174 receives a left-hand circularly polarized wave (LHCP) or a right-hand circularly polarized wave (RHCP) depending on a direction or position with respect to the input probe 114 to convert the wave into the linearly polarized wave.

The polarizer 170 according to the exemplary embodiment of the present invention can convert the circularly polarized signal into the linearly polarized signal by causing a phase shift or a phase difference by the dielectric plate-shaped polarized wave forming part 174 and receive the converted linearly polarized signal through the linearly polarized wave receiving probe 182. To achieve this, the satellite signal receiving apparatus 100 according to the exemplary embodiment of the present invention adopts a structure in which the circularly polarized wave is converted into the linearly polarized wave by rotating the polarizer 170 formed at the single open waveguide by using the single open waveguide 180 instead of individually using waveguides for receiving or converting the linearly polarized wave and the circularly polarized wave.

In the polarizer 170 of the satellite signal receiving apparatus 100 according to the exemplary embodiment of the present invention, since the polarizer rotating section (140, 150) that rotates the polarizer 170 in a direct driving manner or an indirect driving manner such a gear, belt, or a chain is used, it is not necessary to individually form a linearly polarized wave receiving part and a circularly polarized wave receiving part. Further, since the angle between the polarized wave forming part 174 of the polarizer 170 and the power supplying direction of the input probe 114 is changed, it is possible to receive the horizontally polarized wave, the vertically polarized wave, the left-hand circularly polarized wave, and the right-hand circularly polarized wave.

Figure 11A:
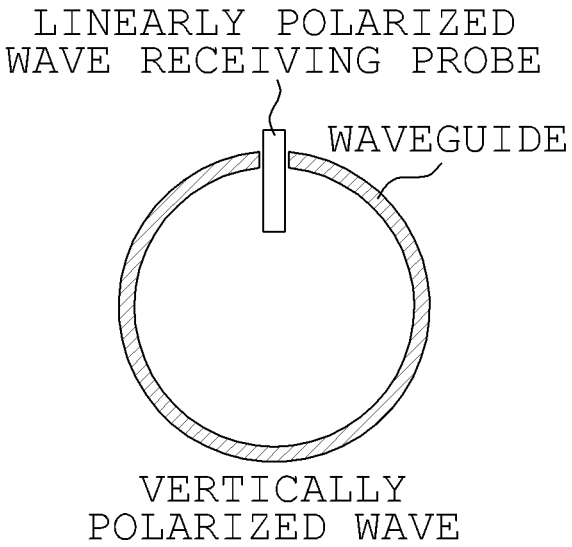
FIGS. 11A to 11F are plan views illustrating a case where a waveguide of the major part shown in FIG. 2 receives a linearly polarized wave and a circularly polarized wave.
Figure 11B:
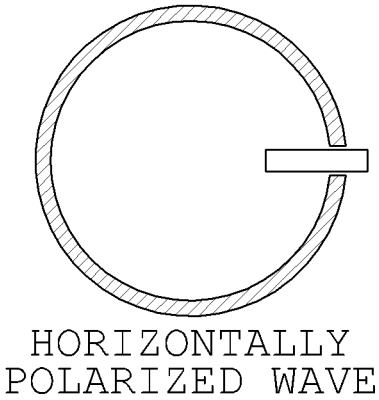

Referring to FIGS. 11A to 11B, when the polarized wave forming part 174 of the polarizer 170 of the satellite signal receiving apparatus 100 according to the exemplary embodiment of the present invention is located in the same direction as the input probe 114 or is rotated to have 180 degrees with respect to the input probe, the polarizer receives the vertically polarized wave. When the polarized wave forming part 174 is rotated to have 90 degrees or 270 degrees with respect to the input probe 114, the polarizer receives the horizontally polarized wave. Moreover, when the polarized wave forming part 174 is rotated to have 45 degrees or 225 degrees with respect to the direction of the input probe 114, the polarizer receives the left-hand circularly polarized wave to convert the wave into the linearly polarized wave. When the polarized wave forming part 174 is rotated to have 135 degrees or 315 degrees with respect to the direction of the input probe 114, the polarizer receives the right-hand circularly polarized wave to convert the wave into the linearly polarized wave.

Figure 11C:
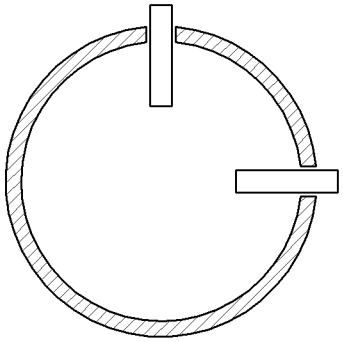
Figure 11D:
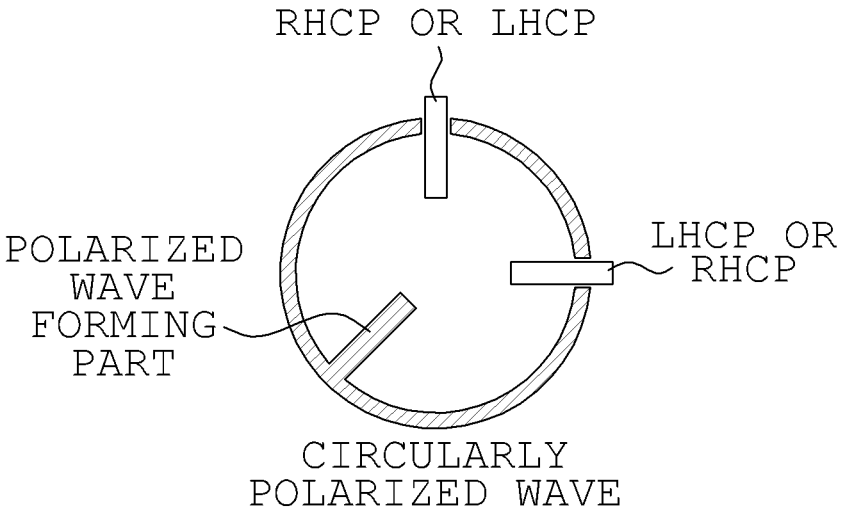

In particular, as shown in FIGS. 11C and 11D, when the input probe of the low noise block down converter 120 is provided by two, the number of polarized waves is increased up to four including the vertically polarized wave, the horizontally polarized wave, the left-hand circularly polarized wave (LHCP), and the right-hand circularly polarized wave (RHCP).

However, in order to rotate the polarized wave forming part 174 with respect to the input probe 114 to have angles other than 45 degrees, the angles formed by the both ends of the rotation restricting part 172 shown in FIGS. 10A and 10B need to be different from each other.

Figure 11E:
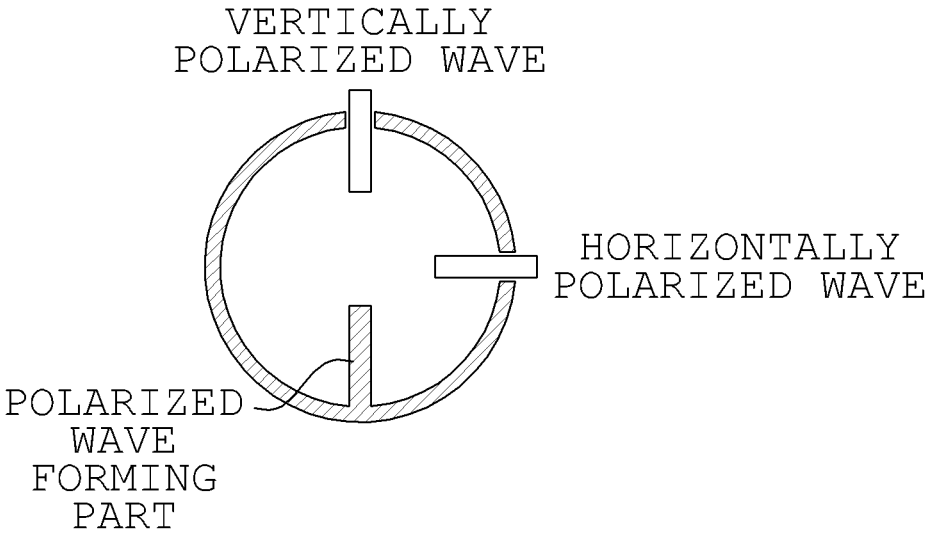
Figure 11F:
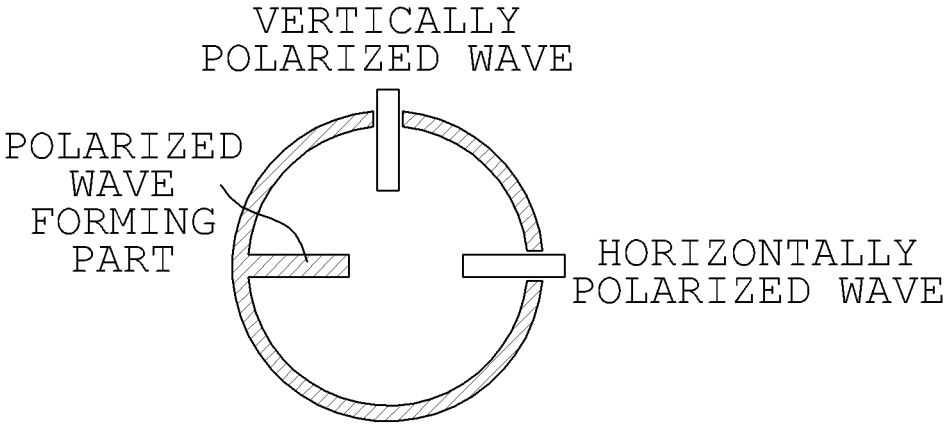

Furthermore, as shown in FIGS. 11E and 11F, when the probe and the polarized wave forming part of the low noise block down converter are vertical to each other, since the probe recognizes only a thin side surface of the polarized wave forming part, it may be determined that the polarized wave forming part does not exist. Further, when the probe and the polarized wave forming part of the low noise block down converter are located in the same direction, the polarized wave forming part has relatively a strong influence on the polarization property as compared to a case where the probe and the polarized wave forming part are vertical to each other. Accordingly, it is necessary to design and manufacture the polarized wave forming part to have a minimum influence on the polarization property.

As described above, a basic principle of the present invention is to receive the circularly polarized wave by inserting the polarized wave forming part to have an angle of 45 degrees with respect to the input probe of the low noise block down converter and to receive the linearly polarized wave by removing the polarized wave forming part as an actual device from the low noise block down converter as if the polarized wave forming part is invisible. In this way, as the method in which the polarized wave forming part as the actual device is electrically removed to receive the linearly polarized wave, the present invention suggests a method in which the linearly polarized wave is received by rotating the polarized wave forming part inserted or formed to have the angle of 45 degrees with respect to the input probe of the low noise block down converter such that the polarized wave forming part is located in the same direction as the input probe of the low noise block down converter or in a vertical direction of 90 degrees with respect to the probe.

In this way, since the polarizer 170 for a multi polarized satellite signal of the satellite signal receiving apparatus 100 according to the exemplary embodiment of the present invention rotates the polarized wave forming part 174 by a desired angle, the polarizer can receive the linearly polarized wave as well as the circularly polarized wave through the single open waveguide 180. In addition, when receiving the linearly polarized wave, it is possible to prevent the polarized wave forming part 174 from influencing on the circular polarization property by hiding the polarized wave forming part 174 by the input probe 114, and it is possible to use the polarized wave forming part 174 only when receiving the circularly polarized wave.

Hereinafter, an operation of receiving the multi polarized satellite signal by the satellite signal receiving apparatus (the satellite tracking antenna) 100 having the skew compensating device 160 or an operation of compensating for the skew angle when receiving the circularly polarized wave will be described.

When the moving body such a ship equipped with the satellite signal receiving apparatus (the satellite tracking antenna) 100 according to the exemplary embodiment of the present invention receives the linearly polarized signal of Ku band, the low noise block down converter may be rotated by the skew angle to compensate for the skew angle caused by the received polarized wave. At this time, the skew compensating device 160 is operated to rotate the low noise block down converter 120, so that it is possible to compensate for the skew angle.

The skew compensating device 160 rotates the pulley 161 by driving the motor 130 to compensate for the skew angle. By providing the skew compensating device 160, when the signal transmitted from the satellite is the linearly polarized satellite signal and the skew angle is caused between the polarized satellite signal and the polarized wave received by the satellite signal receiving apparatus 100 according to the exemplary embodiment of the present invention, the low noise block down converter 120 is rotated by the skew angle to compensate for the skew angle. Thus, it is possible to prevent loss of the satellite signal received depending on the skew angle.

As stated above, although the exemplary embodiments of the present invention has been described in connection with specific matters such as detailed components, limited embodiments, and drawings, they are merely presented for better understanding of the present invention, and the present invention is not restricted by the embodiments. It is to be appreciated that those skilled in the art can change or modify the embodiments. Therefore, the scope of the present invention should not be limited to the above embodiments, but equivalents within the scope of the appended claims should be interpreted as belong to the present invention.

The present invention is applicable to a satellite tracking antenna.

What is claimed is:

1. A satellite signal receiving apparatus, comprising:

a feedhorn that receives a satellite signal;

a low noise block down converter that processes the satellite signal received by the feedhorn;

a skew compensating device that is provided at the low noise block down converter or the feedhorn and rotates the low noise block down converter or the feedhorn to compensate for a skew angle when the satellite signal received by the feedhorn is a linearly polarized wave;

a polarizer that is provided within a single waveguide to be rotated relative to the single waveguide and receives a linearly polarized signal and a circularly polarized signal of the satellite signal; and a polarizer rotating device that rotates the polarizer when the satellite signal received by the polarizer is a circularly polarized wave, and includes a polarizer rotating part that rotates the polarizer by a predetermined angle in a circumferential direction of the single waveguide, wherein the polarizer includes a feedhorn connecting part that has a cylindrical shape and is provided within the single wave wide to be rotated relative to the single waveguide and is communicatively connected to the feedhorn;

a polarized wave forming part that is formed at an inner surface of the feedhorn connecting part in a longitudinal direction of the feedhorn connecting part; and a driven part that is formed at one end of the feedhorn connecting part to receive a driving power of the polarizer rotating part.

2. The satellite signal receiving apparatus according to claim 1, wherein the low noise block down converter includes:

a processing module that includes a processing part for processing a band of the satellite signal received by the feedhorn; and a signal transmission part that is formed at the processing module and includes the single waveguide formed communicatively at a position facing the processing part such that the satellite signal received by the feedhorn is transmitted to the processing part.

3. The satellite signal receiving apparatus according to claim 2, wherein a polarized wave forming part is formed at an inner surface of the polarizer in a height direction of the single waveguide, and the polarizer rotating section rotates the polarizer so as to allow the polarized wave forming part to be located in the same direction as an input probe of the low noise block down converter and in a direction different from the input probe.

4. The satellite signal receiving apparatus according to claim 3, wherein the polarized wave forming part has a pentagonal shape.

5. The satellite signal receiving apparatus according to claim 4, wherein the driven part is formed to extend in a radial direction of the feedhorn connecting part, and includes a rotation restricting part formed to have the same radius of curvature as that of the feedhorn connecting part.

6. The satellite signal receiving apparatus according to claim 5, wherein a stopper that is inserted into the rotation restricting part to restrict a rotation angle of the polarizer is formed at the low noise block down converter, and a controller is configured to detect the contact of the stopper between the rotation restricting part, transmit the detection result to the polarizer rotating part, and stop the operation of the polarizer rotating part.

7. The satellite signal receiving apparatus according to claim 6, wherein when the stopper comes in contact with one end of the rotation restricting part, the polarized wave forming part is located above the input probe, and when the stopper comes in contact with the other end of the rotation restricting part, the polarized wave forming part is located at a position crossing the input probe.

8. The satellite signal receiving apparatus according to claim 5, wherein an angle between the ends of the range of motion of the rotation restricting part is 45 degrees with respect to a center of the feedhorn connecting part.

9. The satellite signal receiving apparatus according to claim 5, wherein when an angle between the polarized wave forming part and the input probe is obtained by adding 45 degrees to multiple of 90 degrees, the polarizer receives the circularly polarized wave, and when the angle between the polarized wave forming part and the input probe is a multiple of 90 degrees, the polarizer receives the linearly polarized wave.

10. The satellite signal receiving apparatus according to claim 4, wherein the polarizer rotating section is connected to the driven part in a direct power transmitting manner, or in an indirect transmitting manner using a gear, a belt, or a chain.

* * * * *